US009303498B2

(12) United States Patent
Grimseth et al.

(10) Patent No.: US 9,303,498 B2
(45) Date of Patent: Apr. 5, 2016

(54) SUBSEA COMPRESSION

(75) Inventors: Tom Grimseth, Oslo (NO); William Bakke, Oslo (NO); Tor Bjørge, Hundhamaren (NO); Håvard Torpe, Oslo (NO); Håvard Eidsmoen, Oslo (NO); Birgitte Nordheim Tveter, Billingstad (NO); Harald Underbakke, Sandnes (NO); Lars Brenne, Sandnes (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 14/239,085

(22) PCT Filed: Aug. 6, 2012

(86) PCT No.: PCT/EP2012/065360

§ 371 (c)(1),
(2), (4) Date: Mar. 21, 2014

(87) PCT Pub. No.: WO2013/023948

PCT Pub. Date: Feb. 21, 2013

(65) Prior Publication Data

US 2014/0202704 A1 Jul. 24, 2014

(30) Foreign Application Priority Data

Aug. 17, 2011 (GB) ..... 1114166.0

(51) Int. Cl.

| | |
|---|---|
| ***E21B 7/12*** | (2006.01) |
| ***E21B 43/18*** | (2006.01) |
| ***E21B 43/01*** | (2006.01) |
| ***E21B 43/36*** | (2006.01) |
| ***E21B 36/00*** | (2006.01) |

(52) U.S. Cl.

CPC ..... *E21B 43/18* (2013.01); *E21B 36/001* (2013.01); *E21B 43/01* (2013.01); *E21B 43/36* (2013.01)

(58) Field of Classification Search

CPC ..... E21B 33/0355; E21B 34/045
USPC ..... 166/338, 351, 368
See application file for complete search history.

(56) References Cited

U.S. PATENT DOCUMENTS

| | | | | |
|---|---|---|---|---|
| 2,666,692 | A * | 1/1954 | Edward et al. | 422/652 |
| 2,688,368 | A * | 9/1954 | Rodgers et al. | 166/267 |
| 2,937,506 | A * | 5/1960 | Stirlen | 62/121 |
| 3,097,917 | A * | 7/1963 | Dotts, Jr. et al. | 95/176 |

(Continued)

FOREIGN PATENT DOCUMENTS

| | | | |
|---|---|---|---|
| GB | 2 186 283 | A | 8/1987 |
| GB | 2 245 917 | A | 1/1992 |

(Continued)

*Primary Examiner* — Matthew R Buck
*Assistant Examiner* — Aaron Lembo
(74) *Attorney, Agent, or Firm* — Birch, Stewart, Kolasch & Birch, LLP

(57) ABSTRACT

Subsea apparatus (10) for processing a well stream (2) and a method of processing a well stream subsea is described. In an embodiment, liquid (5) and gas (3) contained in the well stream (2) is separated. The separated gas (3) is cooled and the cooled gas (32) is combined with the separated liquid (5) to form a wet gas (52) for a compressor (90). An active cooling arrangement (30) may be used in one example to enhance the cooling effect provided by the cooler (30). Advantageously, the apparatus (10) can be arranged compactly, and may be provided on a subsea retrievable module.

21 Claims, 1 Drawing Sheet

(56) References Cited

U.S. PATENT DOCUMENTS

| | | | | | |
|---|---|---|---|---|---|
| 3,404,537 | A | * | 10/1968 | Leonard, Jr. | 62/123 |
| 3,856,078 | A | * | 12/1974 | Dahl | 165/108 |
| 3,908,763 | A | * | 9/1975 | Chapman | 166/302 |
| 4,112,687 | A | * | 9/1978 | Dixon | 60/641.6 |
| 4,339,929 | A | * | 7/1982 | Fitzpatrick et al. | 62/79 |
| 4,363,703 | A | * | 12/1982 | ElDifrawi et al. | 203/10 |
| 4,378,846 | A | * | 4/1983 | Brock | 166/303 |
| 4,506,735 | A | * | 3/1985 | Chaudot | 166/357 |
| 4,533,526 | A | * | 8/1985 | Delacour et al. | 423/1 |
| 4,836,123 | A | * | 6/1989 | Grinde et al. | 114/382 |
| 4,988,372 | A | * | 1/1991 | Meline | 95/283 |
| 5,044,440 | A | * | 9/1991 | Stinessen et al. | 166/344 |
| 6,068,053 | A | * | 5/2000 | Shaw | 166/267 |
| 6,142,215 | A | * | 11/2000 | Paulsen et al. | 165/45 |
| 6,313,545 | B1 | * | 11/2001 | Finley et al. | 290/54 |
| 6,932,121 | B1 | * | 8/2005 | Shivers, III | 141/1 |
| 6,998,724 | B2 | * | 2/2006 | Johansen et al. | 290/1 R |
| 7,037,105 | B2 | * | 5/2006 | Hayes | 432/63 |
| 7,152,682 | B2 | * | 12/2006 | Hopper | 166/357 |
| 8,622,225 | B2 | * | 1/2014 | Goninan | 210/512.1 |
| 8,771,394 | B2 | * | 7/2014 | Skofteland et al. | 55/431 |
| 2004/0031622 | A1 | * | 2/2004 | Butler et al. | 175/5 |
| 2010/0252227 | A1 | | 10/2010 | Sten-Halvorsen et al. | |
| 2011/0048546 | A1 | * | 3/2011 | Bjorge et al. | 137/154 |
| 2012/0097362 | A1 | * | 4/2012 | Kanstad et al. | 165/45 |
| 2012/0103621 | A1 | * | 5/2012 | Kanstad et al. | 166/344 |
| 2014/0223894 | A1 | * | 8/2014 | Tomter et al. | 60/327 |

FOREIGN PATENT DOCUMENTS

| | | | | |
|---|---|---|---|---|
| GB | 2 436 580 | A | | 10/2007 |
| WO | WO 95/15428 | A1 | | 6/1995 |
| WO | WO 2009/131462 | A2 | | 10/2009 |
| WO | WO 2009131462 | A3 | * | 1/2010 |
| WO | WO 2011/008101 | A2 | | 1/2011 |
| WO | WO 2011/066050 | A1 | | 6/2011 |

* cited by examiner

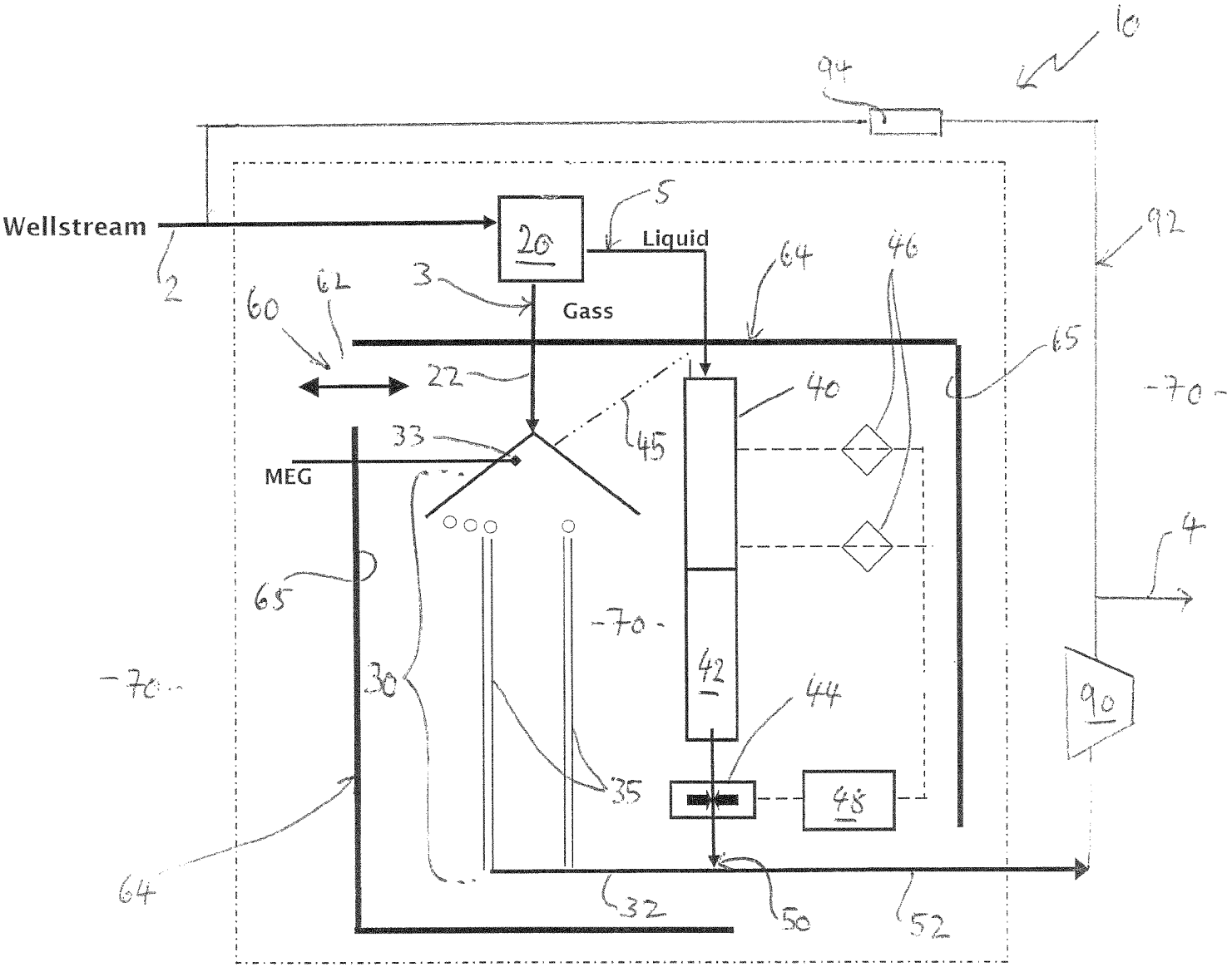
10
92
70
4
90
65
46
94
64
40
44
48
52
50
42
Liquid
5
45
Gass
20
35
32
3
22
33
30
61
60
MEG
65
2
Wellstream
70
64

SUBSEA COMPRESSION

The present invention relates to subsea processing. In particular, but not exclusively, it relates to subsea apparatus for processing a well stream, a subsea module containing such an apparatus and a method of processing a well stream subsea. Particular embodiments of the invention relate to subsea compression of a hydrocarbon well stream in order to boost hydrocarbon production.

In well production, for example in the oil and gas production industry, it can be necessary to compress a well stream in order to ensure sufficient levels of production from the well. Where wells are located subsea and remote distances from other facilities, it can be desirable to compress the well stream at a location near the well head to help transport well stream fluids onward to a surface facility.

For this purpose, compressors can be installed subsea to compress the well stream, in particular the gas phase. This requires some pre-processing of the well stream in order to meet compressor operational requirements. Subsea compressors can for example be sensitive to liquid content in the gas, and may fail if this becomes too large posing a risk to production. This imposes constraints on the type of processing required and how such equipment must perform.

Conventionally, pre-processing begins at a far upstream end, with a passive inlet cooler receiving the whole raw well stream direct from the well head, cooling the well stream significantly from a typical temperature of around 75 degrees Celsius to around 20 degrees Celsius. Cooling is necessary to compensate for an increase in temperature which is caused subsequently due to compression.

After cooling, the well stream is separated into a gas phase and a liquid phase. Typically, the gas is compressed, and thereafter re-combined with the liquid phase and transported away from the well. Alternatively, a wet gas compressor can be used which is tolerant to a presence of a certain amount of liquid within the gas phase. In this case, separate gas and liquid phases can be mixed in an appropriate ratio and then supplied to the compressor for transport away from the well.

There are various drawbacks associated with today's solutions. The equipment used is relatively large in size, and high performance separation equipment can be required in order to meet compressor requirements and to optimise production. Furthermore, increasing numbers of oil and gas fields are being developed in deep water areas and in remote locations. This presents significant logistical challenges. There arises therefore a need for simplification and cost reduction, in particular a need to simplify installation and maintenance.

However, the existing configuration of pre-processing systems with respect to cooling of the well stream is thought to be beneficial. The coolers handle the whole well stream flow through multiple cooling pipes immersed in sea water. The sea water, typically at a temperature between around 4 to 6 degrees Celsius at the sea bed, acts as a cooling medium for cooling the well stream. Incoming flow is split into the cooling pipes helping to ensure an even distribution of liquid and gas. With both liquid and gas present, an enhanced cooling effect is imparted to the gas by the liquid because the liquid has a higher heat capacity than the gas. This is considered to be a particularly important effect for enhanced cooling. Such coolers are conventionally thought therefore to be a well-functioning part of the system despite for example being relatively large in size. Research efforts to date have generally focused on other areas for example on actual improvements to the compressor and on the practicalities of mixing liquid and gas to form a wet gas supply for the compressor.

According to a first aspect of the present invention, there is provided subsea apparatus for processing a well stream, the apparatus comprising: a separator arranged to separate, at least partly, liquid and gas contained in the well stream to produce separated liquid and gas; a cooler positioned downstream of said separator and arranged to cool said separated gas to produce cooled gas; and combining means positioned downstream of said cooler and arranged to combine said cooled gas with said separated liquid to form a wet gas for a compressor.

A cooling rate of the cooler may be controllable. Cooling may be controlled to produce a desired temperature of the cooled gas and/or the wet gas.

The apparatus may have an active cooling arrangement operable to circulate a cooling medium past at least a part of the cooler. The cooler may comprise at least one cooling tube immersed in the cooling medium, and the cooling medium may be circulated upon operation of the active cooling arrangement past at least a portion of an outer surface of the cooling tube.

The active cooling arrangement can include a pump for circulating the cooling medium. The pump may have an impeller, for example mounted on a rotatable shaft, which may be driven by a motor. The pump may operate by a magnetic coupling or other drive mechanism. The operation of the pump and/or of the active cooling arrangement may be dependent upon the rate of cooling of the cooler or a temperature of the cooled gas and/or wet gas. The rate of cooling or temperature of cooled gas and/or wet gas may be measured. The cooling rate may be measured, for example by measuring a temperature of the cooled gas, wet gas and/or the separated gas prior to entry to the cooler.

The cooling medium is preferably sea water. The active cooling arrangement may include at least one guiding surface arranged to guide or channel the cooling medium past at least said part of the cooler.

The cooler may have at least one cooling tube dimensioned for generating a sufficient pressure differential between the cooled gas and the liquid for driving an amount of the liquid into mixture with the cooled gas. The at least one cooling tube may be dimensioned with respect to at least one parameter selected from the group consisting of: (i) number; (ii) length of tube; and (iii) diameter of tube. The dimensions may in general depend upon a flow rate of the well stream. In particular, when the flow rate of the well stream well stream is reduced, for example upon reservoir depletion and loss of reservoir pressure and there arises a need to boost the well stream pressure, conditions facilitate creation of a significant differential for this purpose. A significant pressure drop can be created in the gas over the length of the tubes, for enabling creation of the necessary pressure differential.

The subsea apparatus may include a collecting container arranged to receive the separated liquid of the well stream and to supply a controllable amount of the liquid into mixture with the cooled gas for forming the wet gas. A pressure of the collecting container may differ from that of the cooled gas sufficiently for driving the amount of liquid into mixture with the cooled gas. The collecting container may be dimensioned with regard to at least one parameter selected from the group consisting of: (i) height of container; (ii) liquid capacity; and (iii) liquid height. Typically, the container may be an elongate tank arranged substantially vertically along its longitudinal axis, thus the container may be regarded to provide a liquid collecting column.

Separation of liquid and gas allows separated liquid to be supplied in a suitable amount to the gas to form the wet gas with the appropriate composition for the compressor. By using a collecting column, liquid supply from the collection column into mixture the cooled gas is controlled and the wet gas stream composition can be made consistent and can be smoothed or averaged out over time compared with the well stream which may have instantaneous variations in composition.

The height or level of liquid inside the collecting container may also contribute to driving an amount of liquid into mixture with the cooled gas. The liquid supply to the cooled gas may be controlled using a flow valve, and may be dependent upon the liquid level in the collecting container. A level sensor and/or controller may be used to control the flow valve. The flow valve may thus be operable in response to a measured level by the level sensor. The controller may be programmed to operate the flow valve in response to a received measurement signal from the level sensor, for example to control the amount or flow rate of liquid permitted through the valve for combining with the gas.

The cooling arrangement may be arranged to circulate the cooling medium past a part of the collecting container in order to cool the liquid contained inside the collecting container. The active cooling arrangement may include at least one guiding surface arranged to guide or channel the cooling medium past at least said part of the collecting container.

The apparatus may include the compressor, which may be arranged to receive and compress the wet gas stream. The compressor may be a liquid-tolerant compressor, and may be a centrifugal compressor. The wet gas may be supplied to a plurality of such compressors operating in parallel.

The apparatus may not require any cooler upstream of the separator. It may not require any further separator or cooler used upstream or downstream of the separator, and upstream of the compressor. The apparatus may also not require any further separator or cooler provided downstream of said cooler.

According to a second aspect of the invention there is provided a retrievable subsea module, for example a subsea compression module, containing the subsea apparatus of the first aspect of the invention.

According to a third aspect of the invention, there is provided method of processing a well stream subsea, comprising the steps of: separating, at least partly, liquid and gas contained in the well stream to produce separated liquid and gas; after performing said separating step, cooling said separated gas to produce cooled gas; and combining said cooled gas with said separated liquid to form a wet gas for a compressor.

The method may include the steps of providing subsea apparatus according to the first aspect of the invention and using the apparatus to perform the method of the third aspect of the invention. The method may include further steps and features corresponding to the features defined above in relation to the first and/or second aspects of the invention.

The well stream may be a hydrocarbon well stream. The method may include compressing the wet gas for boosting hydrocarbon production.

The invention provides significant advantages. Cooling is performed on the separated gas of the well stream. This reduces the volume of fluid required to be cooled and therefore reduces the size of equipment. Use of an active cooling arrangement makes the cooling of the gas particularly effective, again reducing equipment size. The conventional use of a bulk inlet cooler upstream of the separator is not necessary. No further separation or cooling is required. By arranging the apparatus this manner, and in particular combined with use of active cooling, the inventors have gone against conventional thinking and have provided a solution whereby the size of the apparatus for wet gas compression subsea can be significantly reduced and the apparatus can be arranged on a single retrievable subsea module for example on a subsea compression module or compression station template.

There will now be described, by way of example only, embodiments of the invention with reference to the accompanying drawing, FIG. 1, which is a schematic representation of subsea processing apparatus according to an embodiment of invention.

Referring now to FIG. 1, subsea apparatus 10 for processing a well stream includes a well stream splitter 20 (constituting a separator), a cooler 30 and a liquid collecting column 40 (constituting a collecting container). The well stream splitter 20 receives a raw, unprocessed well stream 2 directly from a well. No cooling takes place upstream of the splitter 20. The well stream 2 is generally a multiphase well stream containing gas and liquid. For purposes of this description, the well stream is a hydrocarbon well stream which typically comprises various hydrocarbon liquids and gas, gas condensates, and water.

At the splitter 20, liquid and gas contained in the well stream are separated from each other, into a respective gas part 3 and a liquid part 5. The separation performed by the splitter 20 is however a rudimentary, low efficiency separation of gas and liquid phases, and may be carried out using conventional compact separation technology, for example the known "CompactSep" technology marketed by FMC Technologies/CDS. Thus, the gas part 3 may include some liquid. Conversely, the liquid part 5 may contain some gas. The separator may comprise a simple vertical tank with a spiral inlet to produce a centrifugal flow within the tank allowing liquid to separate out and be removed from a lower part of the tank whilst gas can be removed from a top part of the tank. High performance scrubbers are not used or required.

The gas part 3 is directed in gas stream 22 to the cooler 30. The cooler 30 cools the gas stream 22, producing a cooled gas stream 32 having a lower temperature compared with that of the gas stream 22 entering the cooler. As a result of the cooling, the gas stream 32 will have a somewhat higher liquid content compared with that of the gas stream 22.

The liquid part 5 is directed to the liquid collecting column 40, in which liquid is contained and from which the liquid 42 is supplied controllably and mixed into the cooled gas stream 32 at a mixing point 50, providing a wet gas stream 52 for supply through a liquid tolerant compressor 90 which compresses the wet gas. A controllable flow valve 44 is provided to control a supply of liquid from the collecting column 40 into mixture with the cooled gas stream 32.

By containing liquid and supplying it in a controlled fashion to the cooled gas stream 32 using the flow valve 44, the composition of the resulting wet gas stream 52 can be controlled and is unaffected by instantaneous variations in the proportion of liquid to gas in the well stream, for example as may occur in the presence of transient slugs. In particular, the wet gas stream 52 may be controlled so that its composition is within a specified working range or tolerance range for the compressor 90.

Thus, the compressor operational envelop controls aspects of the design and function of the apparatus. The wet gas typically has a composition in the range of up to around 5% by volume liquid. This may be a suitable composition for a normal working range of a typical wet gas compressor, where for example the compressor operates at a speed of 50% or above. Greater amounts of liquid may be accepted at lower compressor speeds. The operational envelop of the compressor may be set according to expected well stream rates.

The splitter 20 is designed to capture and separate typically around 50% of the liquid in the well stream under normal operation. The principle is that the splitter separates sufficient liquid from the well stream to allow liquid to be supplied into the cooled gas stream 32 from the collecting column and form a wet gas stream 52 which has the required composition, a consistent composition over time, and/or which is unaffected by variations in well stream composition or pressures. The liquid-in-gas content of the gas part from the splitter would typically be in a range between around 1% to around 3% by volume liquid.

Small amounts of gas may follow the liquid part of the well stream from the splitter and be received in the collecting column where it will tend to separate out of the liquid. Such gas is allowed to escape may be fed back into the gas part 3 through a connecting tube 45, in this embodiment, into the gas stream 22 ahead of the cooler. This helps to keep gases and liquids separate.

In alternative examples, the splitter 20 could be designed with a liquid collecting facility and liquid could be supplied from the liquid collecting facility to the cooled gas stream 32, in a controllable fashion, without using a separate collecting column 40.

However, a benefit of having a separate collecting column 40 as shown in FIG. 1 is that it can be arranged vertically as indicated in FIG. 1 with a significant height and liquid volume in order to help drive a flow of liquid from the collecting column through the valve 44 into mixture with the cooled gas stream 32. This may also provide better freedom of design and improve compactness.

The apparatus 10 is also provided with an active cooling arrangement 60, which enhances the cooling effect provided by the cooler 30. The cooler 30 comprises a plurality of cooling tubes 34 through which the gas stream 22 is passed. The cooler 30 and cooling tubes 34 are immersed in sea water 70 which acts as a cooling medium for the gas stream. Thus, heat is transferred from the gas stream 22 to the sea water 70 across outer surfaces 35 of the tubes simply by flow of the gas stream through the tubes. The active cooling arrangement 60 is arranged to circulate sea water past the cooler, in and around the cooling tubes, such that sea water near the outer surfaces of the tubes is replenished with fresh, cold sea water enhancing the cooling effect. In FIG. 1, a sea water pump 62 is used to circulate the sea water. By circulating sea water in this way, a good temperature contrast can be maintained between the well stream and the sea water, which improves cooling efficiency. Typically, the temperature of the gas stream 22 from the splitter will be similar to that of the well stream 5 whilst the sea water temperature at the sea bed is around 4 degrees. In this example, the sea water pump 60 works by a magnetic coupling mechanism but sea water pumps using other kinds of drive mechanism may be used to impart circulation of seawater. The cooling tubes 34 are dimensioned to provide the necessary cooling, for example to produce a cooled gas stream 32 of around 20 degrees Celsius.

The active cooling arrangement 60 may also include a skirt 64 surrounding the cooler 30 at least in part. The skirt includes guide surfaces 65 which are positioned and oriented in order to channel or guide sea water past the cooler. For example, the guide surfaces 65 may define a channel that guides or controls a direction of circulation of the sea water past the cooler when the pump 62 is used.

In a variant, the collecting column 40 may be arranged such that fluids contained in the column can be cooled to the surrounding sea water 70. Useful cooling of the liquid in the collection column may be provided by using the active cooling arrangement 60 to circulate sea water past the collecting column. This may be a lesser effect than that achieved by the cooler 30 due to the cooler comprising a plurality of tubes by which the gas is exposed to a large surface area across which heat is transferred to the seawater. The skirt may therefore also surround at least in part the collecting column, as shown in FIG. 1, and/or any other component or combination of components of the apparatus which may advantageously be cooled. In another example, the skirt may also surround the splitter.

By using the active cooling arrangement 60, the cooling of the gas stream, and in some embodiments the liquid passing through the collecting column, can be controlled and optimised. Consequently, the wet gas stream 52 temperature can be controlled. The pump 62 may be selectively engaged, when required, to increase cooling, cooling rates and/or to adjust temperature as desired. For example, if the cooling rate reduces, the pump may be started in order to circulate seawater and increase the cooling rate. The pump 62 may be driven by an electric powered motor. The motor and pump may be started in response to a temperature or cooling rate measurement. Control electronics may be provided and programmed to start the pump or control a speed of the pump when the temperature or cooling rate measurement meets certain predefined conditions or passes selected threshold values.

There are further features to note in FIG. 1. For example, the collecting column 40 can be used to ensure that the composition of the wet gas stream 52 remains consistent and that variations in composition are evened out over time. Eventually, the whole of the liquid in the liquid part of the well stream passes through the collecting column 40 and through the compressor (together with the gas stream) and the ratio of gas to liquid in the well stream may change over the long term. The collecting column is provided with liquid level detectors 46 which measure the level of the liquid contained inside the column 40. Signals from the level detectors are received by a controller 48 and used to control the flow valve 44. The controller 48 may thus be programmed to operate the flow valve in response to measurements made by the level detectors. If for example the liquid level is detected as high, the flow valve may increase the amount of liquid supplied into mixture with the cooled gas stream 32, and vice versa, if the level is low, less liquid may be supplied to the cooled gas stream. Increases or decreases in supply of liquid may be gradual over time. In order to ensure an optimal composition of the wet gas stream 52 for the compressor, the cooling rate of the cooler 30 and/or collecting column 40 and resulting temperatures of cooled gas stream or liquid may be adjusted, in response to or in order to accommodate increases or decreases in liquid supplied from the collecting column. For example, the active cooling arrangement 60 may be engaged or disengaged by activation or deactivation of the pump 62 to control the cooling rate, as described above.

Further, there is a need typically to prevent gas hydrates from forming and causing blockages upon cooling of the gas stream, and there is therefore injected monoethyleneglycol (MEG) or other hydrate inhibitor into the gas stream at an injection point 33 upon entry of the gas stream 22 into the cooler 30.

The apparatus 10 is also designed such that liquid 42 is combined with or mixed into the gas stream 32 naturally, without using pumps or additional compression equipment. This helps to reduce complexity. More specifically, a pressure drop will occur across the cooling tubes, dependent upon for example their length and degree of cooling, and the well stream flow rate which is typically in a range between 5 m/s and 10 m/s. The pressure of the cooled gas stream 32 is therefore less than the pressure of the well stream and/or the pressure inside the collecting column 40. It is noted that the temperature of the fluid in the collecting column will typically be higher than that of the cooled gas stream. The pressure difference between fluid in the collecting column and the cooled gas drives liquid into mixture with the cooled gas stream.

The cooler tubes 35 can be constructed with particular dimensions and lengths to achieve a desired pressure drop across the cooler such that a pressure difference is created which is sufficient to drive the liquid naturally into mixture with the gas stream to form the wet gas stream 52. For example, the cooling tubes may be designed to achieve a pressure drop of around 1 bar. A higher well stream flow rate produces a greater pressure drop. Thus, the design of the cooling tubes depends on the well stream flow rate, which is typically in a range between 5 m/s and 10 m/s. In addition, the collecting column is dimensioned such that the liquid volume in the collecting column has a weight sufficient to significantly contribute to driving a flow of liquid from the collecting column into the gas stream. For example, it may be designed to have a liquid height of around 5 m in the liquid column during normal operation producing a 0.5 bar positive head above the flow valve 44. The design of the cooling tubes 34 and collecting column 40 may therefore together create an overall pressure difference of around 1.5 bar for driving the liquid into mixture with the cooled gas stream 32. The height of the liquid level in the collecting column and the pressure drop across the cooler may create the forces necessary to mix liquid into the gas stream and form the wet gas of the wet gas stream 52. The collecting column may therefore be designed with respect to parameters such as capacity, diameter and length to establish an appropriate height of liquid in the collecting column. The degree of cooling of the cooler and/or the collecting column, as controlled by the active cooling arrangement, may also be taken into account and may be used to help establish and maintain the required natural pressure difference for flow of liquid into the gas stream.

The apparatus 10 is located in use on the sea bed locally to a subsea well head, typically in the range of around 100 m to 1000 m from the well head. More specifically, the subsea processing apparatus 10 as a whole or in part may be arranged on a retrievable subsea module 80 arranged for location on the sea bed. In FIG. 1, the splitter 20, cooler 30, collecting column 40, and active cooling arrangement are arranged on the same module. The configuration of the apparatus 10 with a cooler operating downstream of the splitter and on the gas part makes collecting the processing functions compactly onto a single module possible, and the use of active cooling can particularly help in this respect. Providing the apparatus on a retrievable module facilitates deployment from the sea surface and maintenance of the apparatus particularly when used in remote locations or in deep water.

In another example, the compressor may be provided on the same subsea module. The retrievable module may then take the form of a subsea compression module or compression station.

The compressor 90 may be a centrifugal compressor or other liquid tolerant compressor. The compressor is typically designed to tolerate and function effectively with a wet gas liquid content in a range of up to around 5% by volume.

In practice, the compressor 90 is also provided with an anti-surge loop 92 provided with an anti-surge valve 94 as is conventional in the art in order to prevent pressure surge damage to the compressor. The anti-surge loop connects an outlet of the compressor to an inlet portion of the well stream 2, upstream of the splitter 20.

The compressor 90 compresses the wet gas stream 52 and produces at an outlet a high pressure processed well stream 4 which is produced and exported to a host receiving facility. The host receiving facility may be an offshore platform or rig, or a land-based facility. No further subsea or seabed separation or cooling of the well stream is carried out downstream of the compressor 90.

It will be appreciated that the well stream 2 is split into parts and conveyed between processing components by suitable pipe work as is commonly employed in the art of subsea processing systems. Various shut-off or other flow valves may also be incorporated into such pipe work in order that equipment can be isolated for example for safety purposes. Bypass pipes may also be provided where appropriate in order that gas or liquid can bypass one or more pieces of equipment if necessary.

The term "subsea" should be understood to include usage in land locked or partially land locked seas, such as lakes, fjords or estuarine channels, in addition to open seas and oceans. Accordingly, it will be understood that the term "sea water" could encompass salt water or fresh water, and mixtures thereof.

Various modifications and/or improvements may be made without departing from the scope of the invention herein described.

The invention claimed is:

1. A subsea apparatus for processing a well stream, the apparatus comprising:

a separator arranged to separate, at least partly, liquid and gas contained in the well stream to produce separated liquid and gas;

a cooler positioned downstream of said separator and arranged to cool said separated gas to produce cooled gas; and a mixing point positioned downstream of said cooler and arranged to combine said cooled gas with said separated liquid to form a wet gas for supply to a compressor provided downstream from said mixing point.

2. The subsea apparatus as claimed in claim 1, wherein a cooling rate of the cooler is controllable.

3. The subsea apparatus as claimed in claim 1, including an active cooling arrangement operable to circulate a cooling medium past at least a part of the cooler, for facilitating cooling of the gas by the cooler.

4. The subsea apparatus as claimed in claim 3, wherein the cooler comprises at least one cooling tube immersed in the cooling medium, and the cooling medium is circulated upon operation of the active cooling arrangement past at least a part of an outer surface of the cooling tube.

5. The subsea apparatus as claimed in claim 3, wherein the active cooling arrangement includes a pump for circulating the cooling medium.

6. The subsea apparatus as claimed in claim 3, wherein the cooling medium is sea water.

7. The subsea apparatus as claimed in claim 3, wherein the active cooling arrangement includes at least one guiding surface arranged to guide the cooling medium past at least said part of the cooler.

8. The subsea apparatus as claimed in claim 1, wherein the cooler has at least one cooling tube dimensioned for generating a sufficient pressure differential between the cooled gas and the liquid for driving an amount of the liquid into mixture with the cooled gas.

9. The subsea apparatus as claimed in claim 8, wherein the at least one cooling tube is dimensioned with respect to at least one parameter selected from the group consisting of: (i) number; (ii) length of tube; and (iii) diameter of tube.

10. The subsea apparatus as claimed in claim 1, including a collecting container arranged to receive the separated liquid of the well stream and to supply a controllable amount of the liquid into mixture with the cooled gas for forming the wet gas, wherein a pressure of the collecting container differs from that of the cooled gas sufficiently for driving the amount of liquid into mixture with the cooled gas.

11. The subsea apparatus as claimed in claim 10, including an active cooling arrangement operable to circulate a cooling medium past at least a part of the cooler, for facilitating cooling of the gas by the cooler, and wherein the active cooling arrangement is operable to circulate a cooling medium past at least a part of the collecting container, for facilitating cooling of the liquid contained the collecting container.

12. The subsea apparatus as claimed in claim 11, wherein the active cooling arrangement includes at least one guiding surface arranged to guide or channel the cooling medium past at least said part of the collecting container.

13. The subsea apparatus as claimed in claim 10, wherein the collecting container is dimensioned with regard to at least one parameter selected from the group consisting of: (i) height of container; (ii) liquid capacity; and (iii) liquid height.

14. The subsea apparatus as claimed in claim 1, including the compressor, which is arranged to receive and compress the wet gas stream.

15. The subsea apparatus as claimed in claim 1, wherein no cooler is required upstream of the separator.

16. The subsea apparatus as claimed in claim 1, wherein no further separator or cooler is used upstream or downstream of the separator, and upstream of the compressor.

17. The subsea apparatus as claimed in claim 1, wherein no further separator or subsea cooler is provided downstream of said cooler.

18. A retrievable subsea module containing the subsea apparatus as claimed in claim 1.

19. A method of processing a well stream subsea, comprising the steps of:

separating, at least partly, liquid and gas contained in the well stream to produce separated liquid and gas;

after performing said separating step, cooling said separated gas to produce cooled gas; and combining said cooled gas with said separated liquid to form a wet gas for a compressor.

20. The method as claimed in claim 19, including the step of providing a subsea apparatus for processing a well stream, the apparatus comprising: a separator arranged to separate, at least partly, liquid and gas contained in the well stream to produce separated liquid and gas; a cooler positioned downstream of said separator and arranged to cool said separated gas to produce cooled gas; and a mixing point positioned downstream of said cooler and arranged to combine said cooled gas with said separated liquid to form a wet gas for supply to a compressor located downstream from the mixing point.

21. The method as claimed in claim 19 wherein the well stream is a hydrocarbon well stream and the method includes compressing the wet gas stream for boosting hydrocarbon production.

* * * * *